US011173513B2

(12) United States Patent
Okuda et al.

(10) Patent No.: US 11,173,513 B2
(45) Date of Patent: Nov. 16, 2021

(54) SURFACE TREATMENT DEVICE COMPRISING A PADDLE FOR STIRRING A SURFACE TREATMENT SOLUTION, PADDLE FOR STIRRING A SURFACE TREATMENT SOLUTION AND METHOD THEREOF

(71) Applicant: C. Uyemura & Co., Ltd., Osaka (JP)

(72) Inventors: Tomoji Okuda, Osaka (JP); Daisuke Matsuyama, Osaka (JP); Masayuki Kiso, Osaka (JP); Daisuke Hashimoto, Osaka (JP); Akira Okada, Osaka (JP); Keita Taniguchi, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 16/368,225

(22) Filed: Mar. 28, 2019

(65) Prior Publication Data

US 2019/0309435 A1 Oct. 10, 2019

(30) Foreign Application Priority Data

Apr. 10, 2018 (JP) ..... JP2018-075360

(51) Int. Cl.
*B05C 3/04* (2006.01)
*B05C 3/09* (2006.01)
(Continued)

(52) U.S. Cl.
CPC ..... *B05C 3/04* (2013.01); *B05C 3/09* (2013.01); *C23C 18/1628* (2013.01);
(Continued)

(58) Field of Classification Search
CPC ..... C25D 21/10; C25D 5/08; C23C 18/16; B05C 3/04
(Continued)

(56) References Cited

U.S. PATENT DOCUMENTS 3,652,442 A * 3/1972 Powers ..... C25D 21/10 204/273
7,390,382 B2 * 6/2008 McHugh ..... C25D 17/008 204/230.3
7,390,383 B2 * 6/2008 McHugh ..... C25D 17/008 204/273
7,931,786 B2 * 4/2011 Wilson ..... C25D 5/18 204/273
(Continued)

FOREIGN PATENT DOCUMENTS

JP 4365143 8/2009
JP 2014-29028 A 2/2014
JP 2018-127649 A 8/2018

OTHER PUBLICATIONS

The European Search Report for the European Application EP 19 16 7344 dated Sep. 9, 2019.
(Continued)

*Primary Examiner* — Karl Kurple
(74) *Attorney, Agent, or Firm* — Haverstock & Owens LLP

(57) ABSTRACT

The purpose of the present invention is to provide a surface treatment device and a paddle with improved strength and uniform plating thickness by uniformly stirring surface treatment solution near an object to be plated. Also, the purpose of the present invention is to provide a surface treatment method capable of stirring for a long period of time, by uniformizing plating thickness, and by improving a strength of a paddle. A surface treatment device comprising at least one plateshaped paddle, in a surface treatment tank, for stirring surface treatment solution near an object to be plated by reciprocally moving the paddle with respect to the object to be plated, wherein the paddle is configured by integrally forming a plurality of square bars provided in depth direction of the surface treatment solution in the surface treatment tank along the object to be plated at regular intervals, and a square bar of the plurality of square bars is provided with a curved surface with respect to the object to
(Continued)

be plated in a cross section in thickness direction of the square bar.

9 Claims, 5 Drawing Sheets

(51) Int. Cl.

| | |
|---|---|
| ***B01F 11/00*** | (2006.01) |
| ***C25D 21/10*** | (2006.01) |
| ***C23C 18/16*** | (2006.01) |
| ***C25D 17/00*** | (2006.01) |
| ***C25D 17/02*** | (2006.01) |
| *B05C 11/11* | (2006.01) |

(52) U.S. Cl.
CPC ..... *C25D 17/001* (2013.01); *C25D 17/02* (2013.01); *C25D 21/10* (2013.01); *B01F 11/0082* (2013.01); *B01F 11/0091* (2013.01); *B05C 11/11* (2013.01)

(58) Field of Classification Search
USPC ..... 204/261, 273; 427/444
See application file for complete search history.

(56) References Cited

U.S. PATENT DOCUMENTS

| | | | | |
|---|---|---|---|---|
| 10,227,706 | B2 * | 3/2019 | Wilson | C25D 21/10 |
| 2004/0262150 | A1 * | 12/2004 | Yajima | C25D 21/12 204/224 R |
| 2005/0089645 | A1 | 4/2005 | Keigler et al. | |
| 2009/0139871 | A1 * | 6/2009 | Saito | C25D 21/10 205/148 |
| 2009/0218231 | A1 * | 9/2009 | Yajima | C25D 21/12 205/96 |
| 2010/0176088 | A1 * | 7/2010 | Dunnebeil | H05K 3/0085 216/83 |
| 2010/0212694 | A1 * | 8/2010 | Keigler | C25D 7/123 134/18 |
| 2011/0073482 | A1 * | 3/2011 | Kuriyama | C23C 18/1628 205/125 |
| 2012/0152749 | A1 * | 6/2012 | Yasuda | C25D 5/18 205/96 |
| 2016/0068988 | A1 | 3/2016 | Uzoh | |
| 2018/0221835 | A1 * | 8/2018 | Masuda | B01F 11/0082 |

OTHER PUBLICATIONS

The Office Action for the Japanese Patent Application No. 2018-075360 dated Mar. 13, 2020.

* cited by examiner

SURFACE TREATMENT DEVICE COMPRISING A PADDLE FOR STIRRING A SURFACE TREATMENT SOLUTION, PADDLE FOR STIRRING A SURFACE TREATMENT SOLUTION AND METHOD THEREOF

BACKGROUND OF THE INVENTION

Field of the Invention

The present invention relates to a surface treatment device comprising a paddle for stirring surface treatment solution, a surface treatment method using a paddle for stirring surface treatment solution, and a paddle for stirring surface treatment solution. The present application claims priority based on Japanese Patent Application No. 2018-075360 filed in Japan on Apr. 10, 2018, which is incorporated by reference herein.

Description of Related Art

In the past, plating solution and surface treatment solution such as pre-treatment solution or post-treatment solution for plating were stirred, in order to perform plating or surface treatment before and after the plating efficiently.

By stirring plating solution and surface treatment solution before and after the plating, it is possible to uniformize plating thickness of an object to be plated.

For example, in Patent Literature 1, plating solution is stirred by using a fin made of elastic material in plate shape facing a direction of a surface to be plated, and by bending the fin in inverse direction with respect to respective moving direction of a paddle at the time of reciprocal movement, and by making a flow of the plating solution along the bent fin to be a flow toward a proximity of the surface to be plated.

Patent Literature 1: JP 4365143 B

SUMMARY OF THE INVENTION

However, by conventional method as indicated in FIG. 1 of Patent Literature 1, only upper part of a paddle 34 is mounted to a paddle shaft 32, and the fin and the paddle are being independent, so a part of surface treatment solution will be stirred strongly and a part of surface treatment solution will be stirred weakly, so it cannot be stirred uniformly, and plating thickness will not be uniform. Further, there is also a problem on strength of the device.

Here, the purpose of the present invention is to provide a surface treatment device and a paddle with improved strength and uniform plating thickness by uniformly stirring surface treatment solution near an object to be plated. In addition, the purpose of the present invention is to provide a surface treatment method capable of stirring for a long period of time, by uniformizing plating thickness, and by improving a strength of a paddle.

A surface treatment device relating to one embodiment of the present invention is a surface treatment device comprising at least one plate-shaped paddle, in a surface treatment tank, for stirring surface treatment solution near an object to be plated by reciprocally moving the paddle with respect to the object to be plated, wherein the paddle is configured by integrally forming a plurality of square bars provided in depth direction of the surface treatment solution in the surface treatment tank along the object to be plated at regular intervals, and a square bar of the plurality of square bars is provided with a curved surface with respect to the object to be plated in a cross section in thickness direction of the square bar.

In this way, it is possible to provide the surface treatment device with improved strength and uniform plating thickness by uniformly stirring surface treatment solution near an object to be plated.

At this time, in one embodiment of the present invention, the curved surface may be provided alternately facing left and facing right with respect to the object to be plated.

In this way, it is possible to stir more uniformly by being able to capture the surface treatment solution with respect to both moving directions when reciprocally moving the paddle.

In addition, in one embodiment of the present invention, the intervals may be formed to be 10 to 30 mm.

In this way, it is possible to uniformize plating thickness more by stirring surface treatment solution uniformly without shielding the object to be plated.

In addition, in one embodiment of the present invention, the square bars may be in square or rectangle shape with a side of 5 to 10 mm.

In this way, it is possible to improve strength and to uniformize plating thickness by stirring surface treatment solution more uniformly, as it will be an optimum size for stirring surface treatment solution.

In addition, in one embodiment of the present invention, the curved surface may be 3 to 10 mm in radius.

In this way, it is possible to improve strength and to uniformize plating thickness by stirring surface treatment solution more uniformly by capturing surface treatment solution more efficiently, as it will be an optimum curved surface of the paddle.

In addition, in one embodiment of the present invention, a distance between the paddle and the object to be plated may be 10 to 30 mm.

In this way, a concern of the paddle contacting the object to be plated will be decreased. In addition, it is possible to prevent a decrease of a stirring force.

In addition, in one embodiment of the present invention, it may further comprise a power means for reciprocally moving the paddle with a stroke of 50 to 200 mm, and with a moving speed of 35 to 600 mm/s.

In this way, it is possible to improve strength and to uniformize plating thickness by stirring surface treatment solution more uniformly, as it will be optimum stroke and moving speed for stirring surface treatment solution.

In addition, in one embodiment of the present invention, the paddle may be provided at both sides of the object to be plated.

In this way, it is possible to uniformize plating thickness at front and back surfaces of the object to be plated, by stirring surface treatment solution uniformly at front and back surfaces of the object to be plated.

In addition, other embodiment of the present invention is a surface treatment method using at least one plate-shaped paddle for stirring surface treatment solution near an object to be plated by reciprocally moving the paddle with respect to the object to be plated, wherein the paddle is configured by integrally forming a plurality of square bars provided in depth direction of the surface treatment solution in the surface treatment tank along the object to be plated at regular intervals, and a square bar of the plurality of square bars is provided with a curved surface with respect to the object to be plated in a cross section in thickness direction of the square bar.

In this way, it is possible to provide the surface treatment method capable of stirring for a long period of time, by uniformizing plating thickness by uniformly stirring surface treatment solution near the object to be plated, and by improving a strength of the paddle.

In addition, other embodiment of the present invention is a plate-shaped paddle for stirring surface treatment solution near an object to be plated by reciprocally moving the paddle with respect to the object to be plated, wherein the paddle is configured by integrally forming a plurality of square bars provided in one direction at regular intervals, and a square bar of the plurality of square bars is provided with a curved surface in a cross section in thickness direction of the square bar.

In this way, it is possible to provide the paddle capable of improving strength and uniformizing plating thickness by uniformly stirring surface treatment solution near an object to be plated.

As explained in the above, according to the present invention, it is possible to provide the surface treatment device and the paddle with improved strength and uniform plating thickness by uniformly stirring surface treatment solution near the object to be plated. In addition, it is possible to provide the surface treatment method capable of stirring for a long period of time, by uniformizing plating thickness, and by improving a strength of the paddle.

BRIEF DESCRIPTION OF THE DRAWINGS

FIG. 8(A) is a sectional view along line a-a' of FIG. 7, FIG. 8(B) is a sectional view along line b-b' of FIG. 7, FIG. 8(C) is a sectional view along line c-c' of FIG. 7, and FIG. 8(D) is a sectional view along line d-d' of FIG. 7.

DETAILED DESCRIPTION OF THE INVENTION

Hereinafter, explaining in detail about preferred embodiments of the present invention, with reference to the drawings. In addition, the embodiments explained in below will not unjustly limit the content of the present invention described in claims, and it is not limited that all the structures explained in the embodiments are necessary as means for solving the problem of the present invention. Explaining about a surface treatment device, a surface treatment method and a paddle relating to one embodiment of the present invention in the following order.

1. Surface Treatment Device
2. Paddle
3. Surface Treatment Method

[1. Surface Treatment Device]

Figure 1:
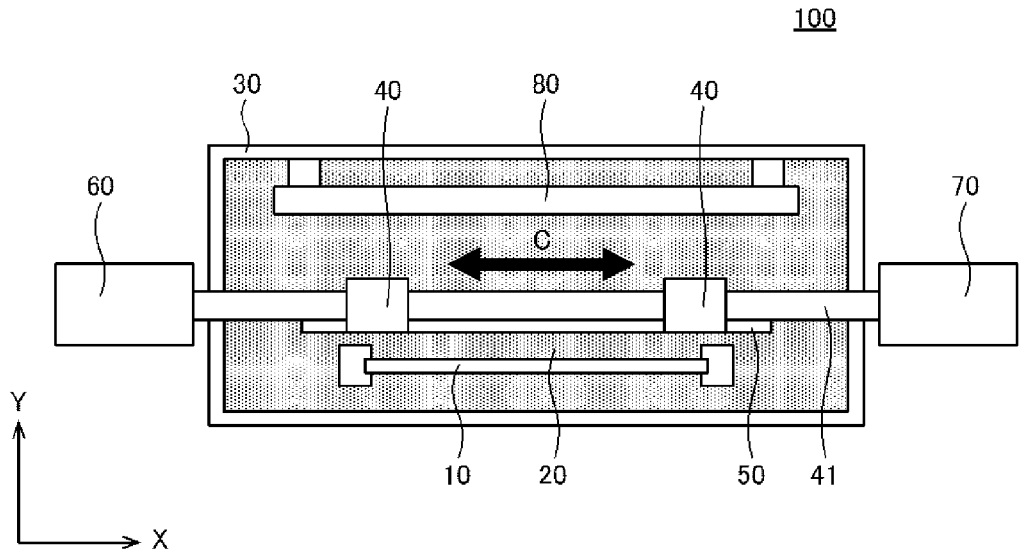
FIG. 1 is a schematic view illustrating a surface treatment device relating to one embodiment of the present invention viewed from above.

As illustrated in FIG. 1, a surface treatment device 100 relating to one embodiment of the present invention comprises at least one plate-shaped paddle 50, in a surface treatment tank 30, for stirring surface treatment solution 20 near an object 10 to be plated by reciprocally moving the paddle 50 in longitudinal direction (X direction) of the surface treatment tank 30 with respect to the object 10 to be plated, as an arrow C. And, the paddle is configured by integrally forming a plurality of square bars provided in depth direction of the surface treatment solution in the surface treatment tank along the object to be plated at regular intervals, and the square bar is provided with a curved surface with respect to the object to be plated in a cross section in thickness direction of the square bar. It is explained in detail in below.

The paddle 50 is fixed to a pole brace 41 by fixing members 40, for example as illustrated in FIG. 1, and a power means 60 for moving the pole brace 41, and a bearing 70 may be provided. In addition, the paddle 50 is arranged between an anode 80 and the object 10 to be plated.

It is preferable that the paddle 50 is arranged in parallel to the object 10 to be plated in stationary condition. In addition, the paddle 50 is reciprocally moved in longitudinal direction (X direction) of the surface treatment tank 30 as the arrow C, but it is preferable that the paddle 50 is reciprocally moved in parallel to the object 10 to be plated. In this way, it is possible to stir the surface treatment solution 20 near the object 10 to be plated more uniformly. In addition, in the surface treatment tank 30 illustrated in FIG. 1, longitudinal direction is X direction, but in a case of a surface treatment tank in which longitudinal direction is Y direction, the paddle 50 is reciprocally moved in lateral direction (X direction) of the surface treatment tank. In other words, the paddle 50 is reciprocally moved in parallel to the object 10 to be plated.

In addition, other than stirring by the paddle 50, a bubbling device may be mounted in the surface treatment tank 30, and the stirring by the paddle 50 may be combined with the stirring by bubbling. In this way, it is preferable for a case when oxygen is necessary in surface treatment solution and when dissolved oxygen should be increased.

In addition, in FIG. 1, the paddle 50 is arranged at one side with respect to the object to be plated, but it may be arranged at both sides of the object to be plated. In this way, it is possible to stir more efficiently, when stirring at both sides is necessary. In addition, more than two paddles may be arranged at one side or both sides of the object to be plated. A number of paddles is adjusted accordingly according to a size of the surface treatment tank and a number of processing of the object to be plated.

Figure 2:
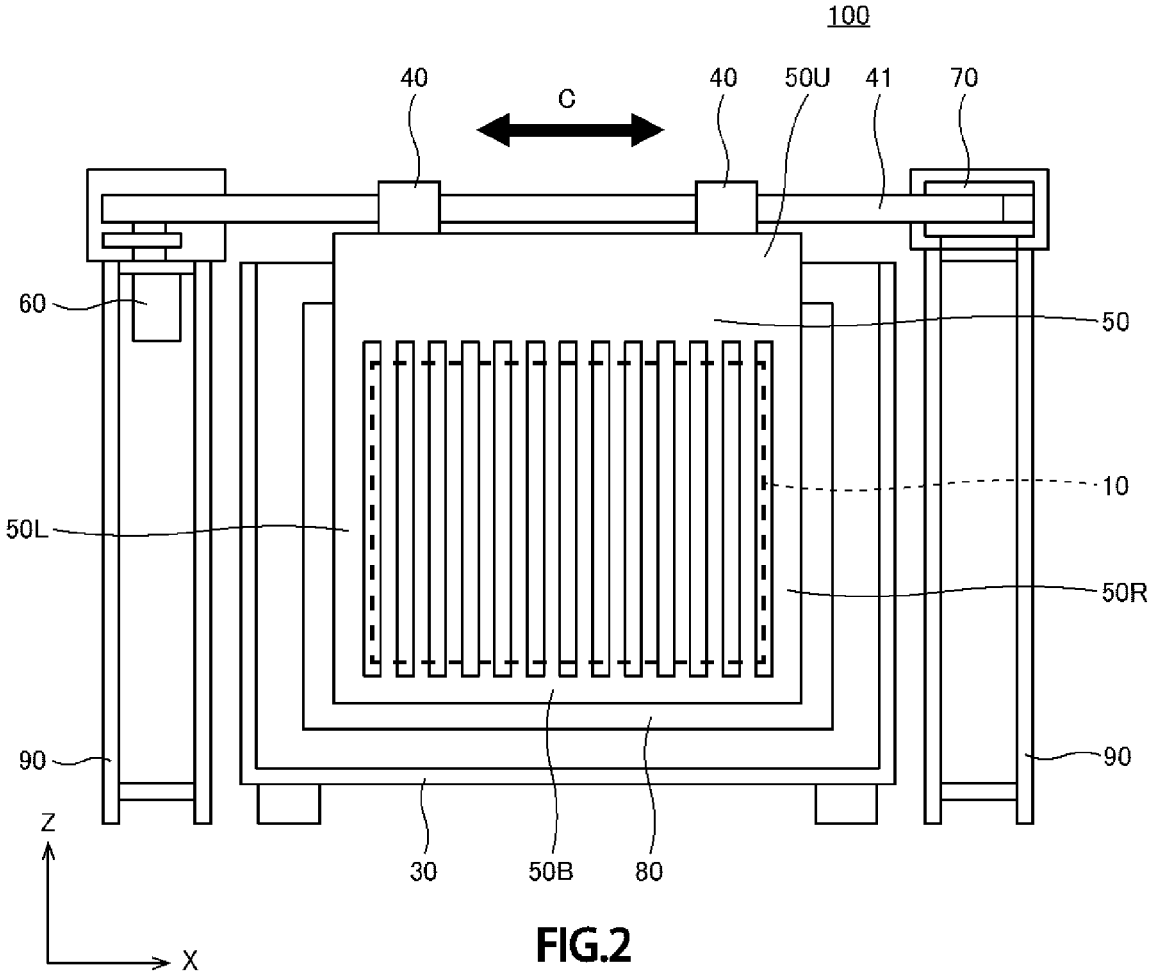
FIG. 2 is a schematic view illustrating a surface treatment device relating to one embodiment of the present invention viewed from a side.

Next, explaining using FIG. 2. FIG. 2 is a schematic view illustrating a surface treatment device 100 relating to one embodiment of the present invention viewed from a side. As illustrated in FIG. 2, the paddle 50 comprised in the surface treatment device 100 is configured by integrally forming a plurality of square bars provided in depth direction (Z direction) of the surface treatment solution at regular intervals. In this way, it is possible to improve strength of the paddle 50.

In addition, as mentioned above, the paddle 50 is fixed to the pole brace 41 for example by the fixing members 40, and the power means 60 for moving the pole brace 41, and the bearing 70 may be provided. Further, a frame 90 for supporting the power means 60 and the bearing 70 may be provided.

As illustrated in FIG. 2, the paddle 50 moves reciprocally as the arrow C. At this time, it is preferable to further comprise the power means 60 for moving the paddle 50 reciprocally with a moving speed of 35 to 600 mm/s, and with a stroke of 50 to 200 mm. As the power means 60, for example a motor or other publicly known means may be used. By using these power means, a moving speed and a stroke may be adjusted.

Further, it is preferable that the object 10 to be plated is arranged at inner side of ends of the paddle 50 (upper end 50U, right end 50R, left end 50L, bottom end 50B) in stationary condition of the paddle 50. In this way, it is possible to stir the surface treatment solution 20 near the object 10 to be plated at corners of the object 10 to be plated more uniformly. More preferably, it is preferable that the object 10 to be plated is arranged at inner side of ends of the paddle 50 (upper end 50U, right end 50R, left end 50L, bottom end 50B) in operating condition.

The surface treatment device 100 relating to one embodiment of the present invention can be applied to electrolyte plating, nonelectrolyte plating or other appropriately desired plating, and especially, it is preferable to be applied to via hole filling and/or through hole filling. In a plating for via hole filling or through hole filling, filling performance will be improved, as additives such as a brightener or a leveler functions efficiently, by stirring efficiently as mentioned above.

The surface treatment device 100 relating to one embodiment of the present invention can be applied to pre-treatment and post-treatment of plating. Especially, it is preferable when efficient stirring of the solution is required. Thus, the surface treatment device 100 relating to one embodiment of the present invention can exert an effect of additives contained in plating solution or in surface treatment solution such as pre-treatment solution and post-treatment solution for plating more efficiently, by stirring efficiently as mentioned above.

In addition, as the object 10 to be plated, plate-shaped object such as printed circuit board, or an uneven object to be decorated can be cited. In addition, the surface treatment device 100 relating to one embodiment of the present invention is effective to the object 10 to be plated provided with holes such as through holes and via holes, especially with high aspect ratio, and to the uneven object.

From the above, according to the surface treatment device 100 relating to one embodiment of the present invention, it is possible to uniformly stir the surface treatment solution 20 near the object 10 to be plated. And, by stirring uniformly, it is possible to uniformize plating thickness as ion exchange at a surface of the object to be plated becomes uniform. In addition, it is possible to provide the surface treatment device with improved strength.

[2. Paddle]

Figure 3:
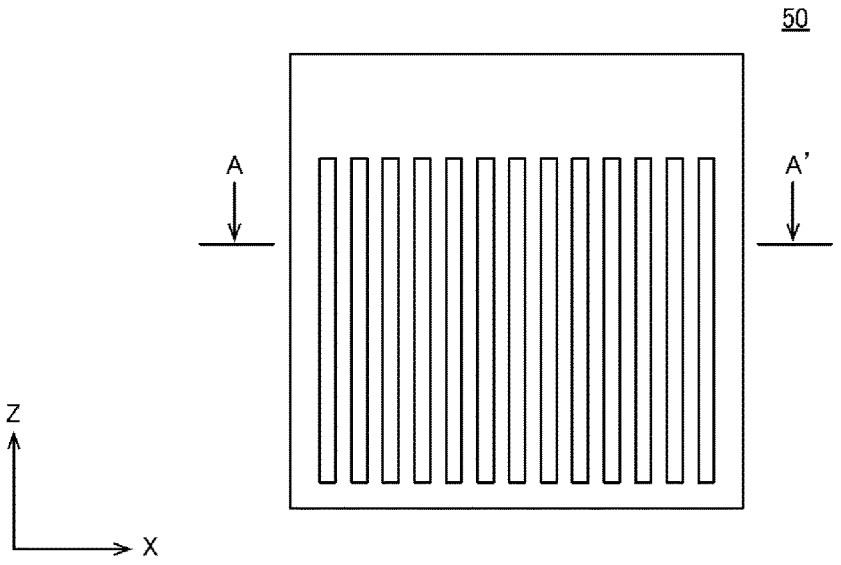
FIG. 3 is a schematic view of a paddle relating to one embodiment of the present invention viewed from a side.

Next, explaining about a paddle 50 used in the surface treatment device 100 relating to one embodiment of the present invention. The paddle 50 relating to one embodiment of the present invention is a plate-shaped paddle for stirring surface treatment solution near an object 10 to be plated by moving the paddle 50 reciprocally with respect to the object 10 to be plated. As illustrated in FIG. 3, the paddle 50 is configured by integrally forming a plurality of square bars provided in one direction at regular intervals, and the square bar is provided with a curved surface in a cross section in thickness direction of the square bar.

By configuring as the paddle 50 relating to one embodiment of the present invention, it is possible to stir surface treatment solution uniformly, and also, shielding effect will not be occurred when plating. Shielding effect may be occurred according to a shape of a paddle, so it is preferable to configure a paddle in a shape of the paddle 50 used in the surface treatment device 100 relating to one embodiment of the present invention.

Figure 4:
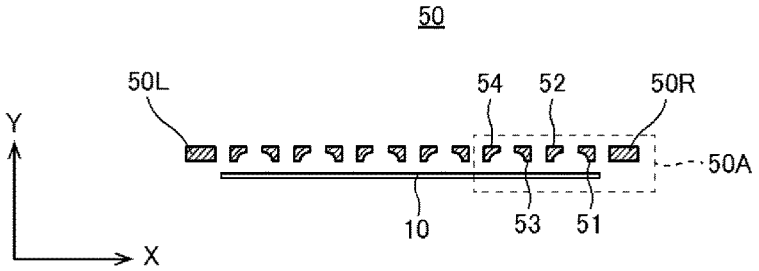
FIG. 4 is a sectional view along line A-A' of FIG. 3.

In addition, a sectional view of the paddle 50 along line A-A' of FIG. 3 is illustrated in FIG. 4. As illustrated in FIG. 4, a square bar 51, 52, 53, 54 (reference number after 54 is omitted) is provided with a curved surface with respect to the object 10 to be plated, in a cross section in thickness direction of the square bar (A-A' cross section). It is preferable that the curved surface is provided alternately facing left and facing right with respect to the object 10 to be plated. In other words, as illustrated in FIG. 4, the square bar 51 with the curved surface facing left and the square bar 52 with the curved surface facing right are provided alternately, and cross-sectional shapes of adjacent square bars 51, 52, 53, 54 are being symmetrical respectively. In this way, it is possible to stir more uniformly, as surface treatment solution can be captured with respect to both moving directions to the left and to the right in X direction, when the paddle is moved reciprocally.

Figure 5:
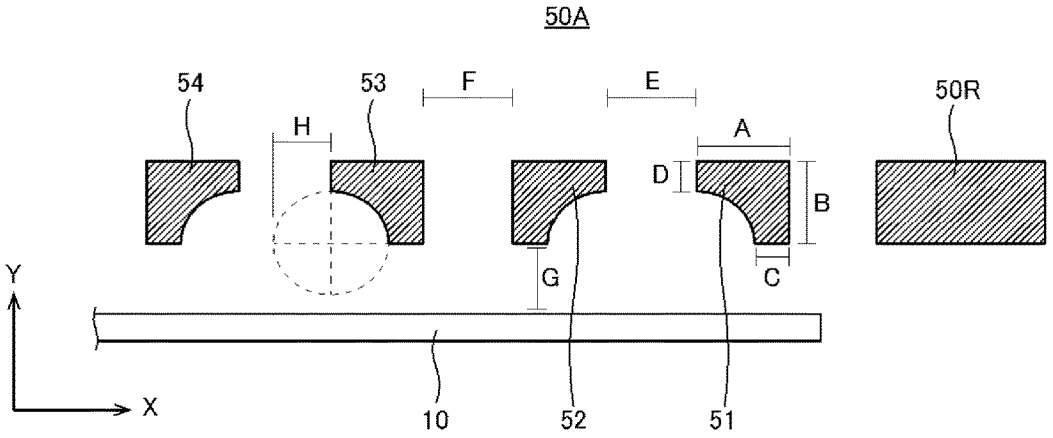
FIG. 5 is an enlarged view of a part of FIG. 4.

Next, explaining the paddle 50 in more detail, using FIG. 5 which is enlarged view of a part 50A illustrated in FIG. 4. The paddle 50 (50A) is configured by integrally forming a plurality of square bars provided in depth direction of the surface treatment solution in the surface treatment tank along the object 10 to be plated at regular intervals. It is preferable that the square bar 51, 52, 53, 54 is in square or rectangle shape with a side of 5 to 10 mm. When indicating by reference numbers of FIG. 5, among four sides of quadrangle, a size of sides A and B not formed with a curved surface is as A=5 to 10 mm and B=5 to 10 mm. In this way, it will be an optimum size for stirring surface treatment solution, and it is possible to uniformize plating thickness by uniformly stirring surface treatment solution, and also, it is possible to improve strength more. Further, strength of the paddle is also improved. In addition, it is preferable that C=2 to 5 mm and D=2 to 5 mm.

When sides A and/or B of the square bar 51, 52, 53, 54 become less than 5 mm, the square bar will be small, so stirring force may be decreased. On the other hand, when sides A and/or B of the square bar become more than 10 mm, stirring force will be improved, but there is a concern that weight of the device will be heavy.

In addition, it is preferable that the intervals of the square bars are formed to be 10 to 30 mm. When indicating by reference numbers of FIG. 5, E=10 to 30 mm and F=10 to 30 mm. In this way, the paddle 50 does not shield the object 10 to be plated with respect to an anode 80, and energization from the anode 80 to the object 10 to be plated is secured, and also, it is possible to uniformize plating thickness more by stirring surface treatment solution uniformly. When the intervals become less than 10 mm, shielding effect with respect to the anode 80 will occur when plating, and energization from the anode 80 to the object 10 to be plated cannot be secured, and there is a case that it is difficult to uniformize plating thickness. On the other hand, when the intervals become more than 30 mm, a number of the square bars themselves provided at the paddle 50 will be decreased, so there is a case that it is difficult to stir surface treatment solution near the object 10 to be plated efficiently.

It is preferable that the curved surface is 3 to 10 mm in radius. When indicating by reference numbers of FIG. 5, H=3 to 10 mm. In this way, it will be an optimum curved surface of the paddle, and it is possible to uniformize plating thickness by stirring surface treatment solution more uniformly by capturing surface treatment solution more efficiently, and also, and it is possible to improve strength of the paddle 50 more. When radius of the curved surface becomes less than 3 mm, there is a case that it is not possible to capture the surface treatment solution more efficiently as an area of the curved surface is decreased. On the other hand, when radius of the curved surface becomes more than 10 mm, there is a case that strength of the paddle 50 is decreased.

In the paddle 50 used in the surface treatment device 100 relating to one embodiment of the present invention, the square bars are integrally formed at regular intervals and provided with the curved surface. In other words, cross-sectional shape of the paddle 50 (50A) will be the square bars 51 to 54 illustrated in FIG. 5. Here, the shape for stirring surface treatment solution may not be in the cross-sectional shape illustrated in FIG. 5, and shapes indicated in the prior arts such as trapezoid, rhombus, triangle, crescent, simply L-shaped or T-shaped may be considered, but trapezoid, rhombus and triangle are not sufficient in capturing surface treatment solution efficiently, and it is difficult to stir efficiently. Thus, the paddle with the cross-sectional shape illustrated in FIG. 5 is able to stir surface treatment solution most efficiently, and also, it is possible to improve strength of the paddle 50 and also the surface treatment device 100.

In addition, it is preferable that a distance between the paddle 50 (50A) and the object 10 to be plated is 10 to 30 mm. When indicating by reference numbers of FIG. 5, G=10 to 30 mm. When the distance is less than 10 mm, there is a significant concern that the paddle will contact the object to be plated. When the distance is more than 30 mm, distance between the paddle 50 and the object 10 to be plated will be apart, so there is a case that stirring force will be decreased.

Figure 6:
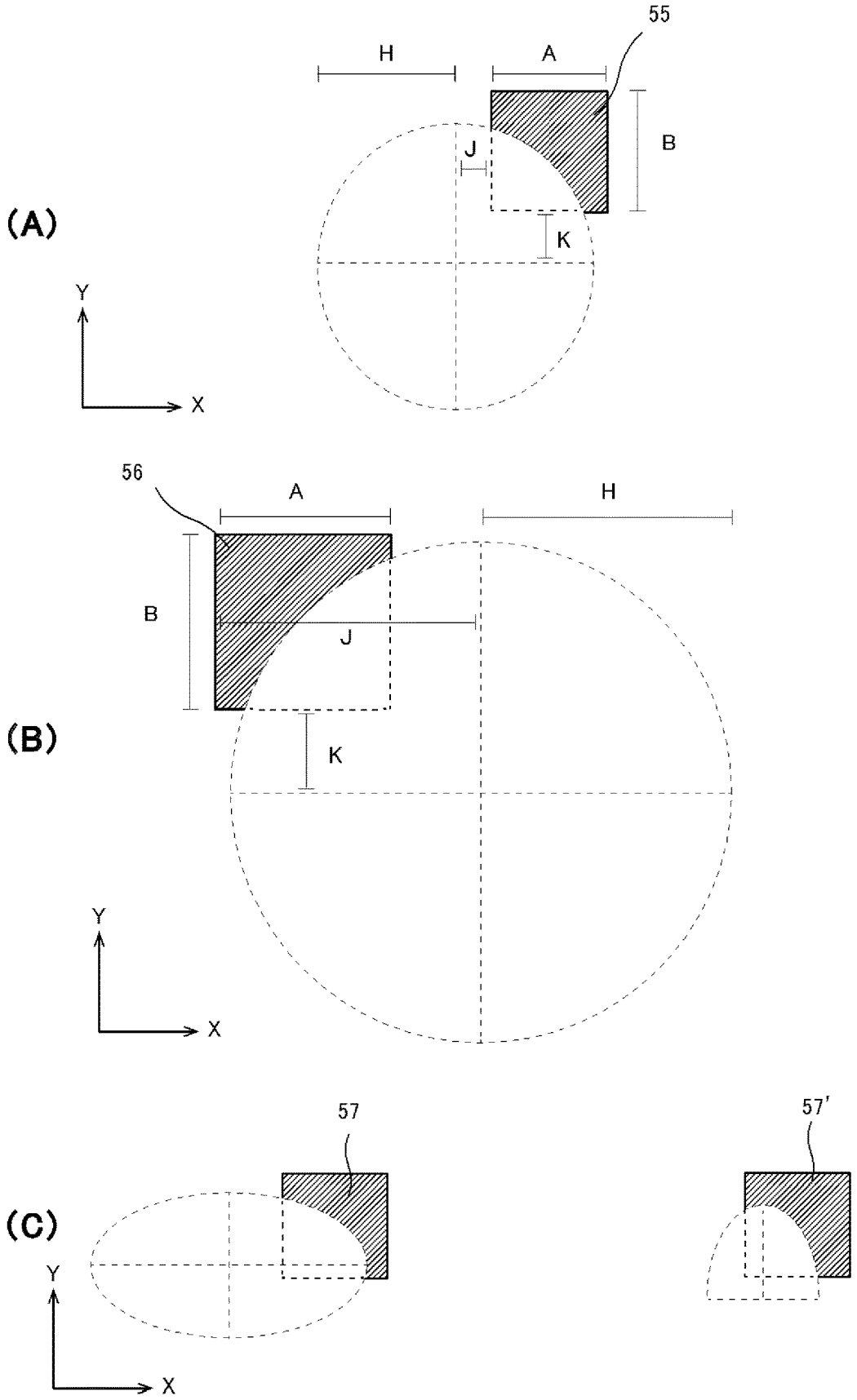
FIG. 6 shows additional examples of parameters of curved surface provided at a square bar.

Further, as additional examples of parameters of curved surface in the paddle 50, as illustrated in FIG. 6, it may be A, B=5 to 10, H=1 to 15, J=−15 to 15, K=−15 to 15 (however, regarding J and K, outside of the square bar 55 is indicated as +, and inside of the square bar 55 is indicated as −). For example, as parameters of curved surface of the square bar 55 illustrated in FIG. 6(A), it will be A=6, B=8, H=8, J=3, K=2. In addition, for example, as parameters of curved surface of the square bar 56 illustrated in FIG. 6(B), it will be A=10, B=10, H=15, J=−15, K=5. In addition, the curved surface is illustrated as true circle for convenience sake, but as illustrated in FIG. 6(C), curved surface provided at the square bars 57, 57' may be oval or parabola. It is fine as long as it is having such curved surface.

From the above, according to the paddle 50 relating to one embodiment of the present invention, it is possible to provide the paddle capable of improving strength and uniformizing plating thickness by uniformly stirring the surface treatment solution near the object to be plated.

Figure 7:
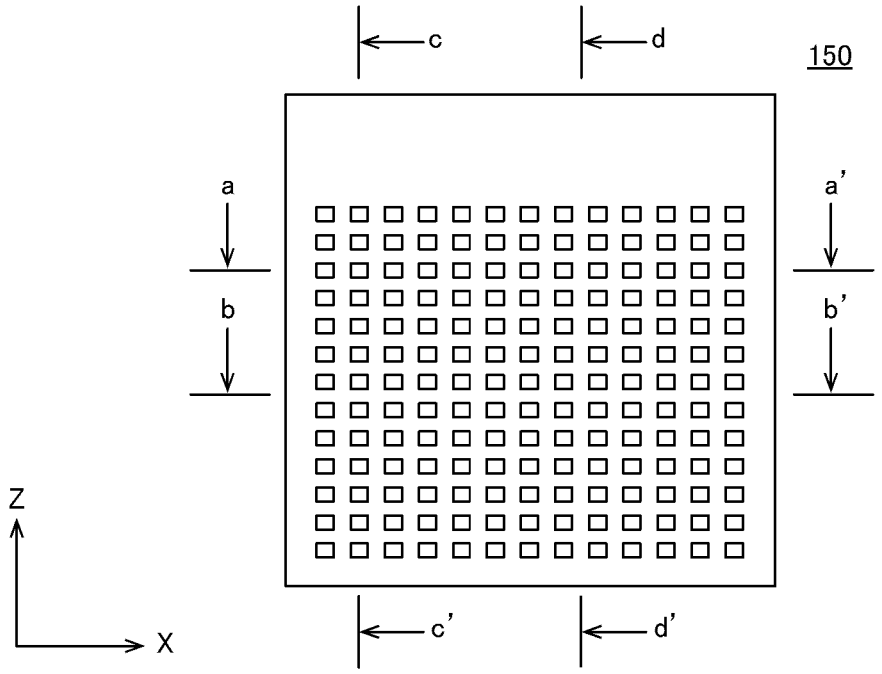
FIG. 7 is a schematic view of a paddle relating to other embodiment of the present invention viewed from a side.

As other embodiment of a paddle 150 relating to one embodiment of the present invention, it may be in a shape illustrated in FIG. 7, other than a grid shape illustrated in FIG. 3. The paddle 150 illustrated in FIG. 7 is in plate shape, and a plurality of through holes are provided in rows in left right and up down directions, and a plurality of counterbores (concave) in spherical shape are provided in an area other than an area provided with the through holes. In addition, the counterbore may be arranged at a position adjacent to the through hole and/or at a position that the through holes are being diagonal to each other.

Figure 8:
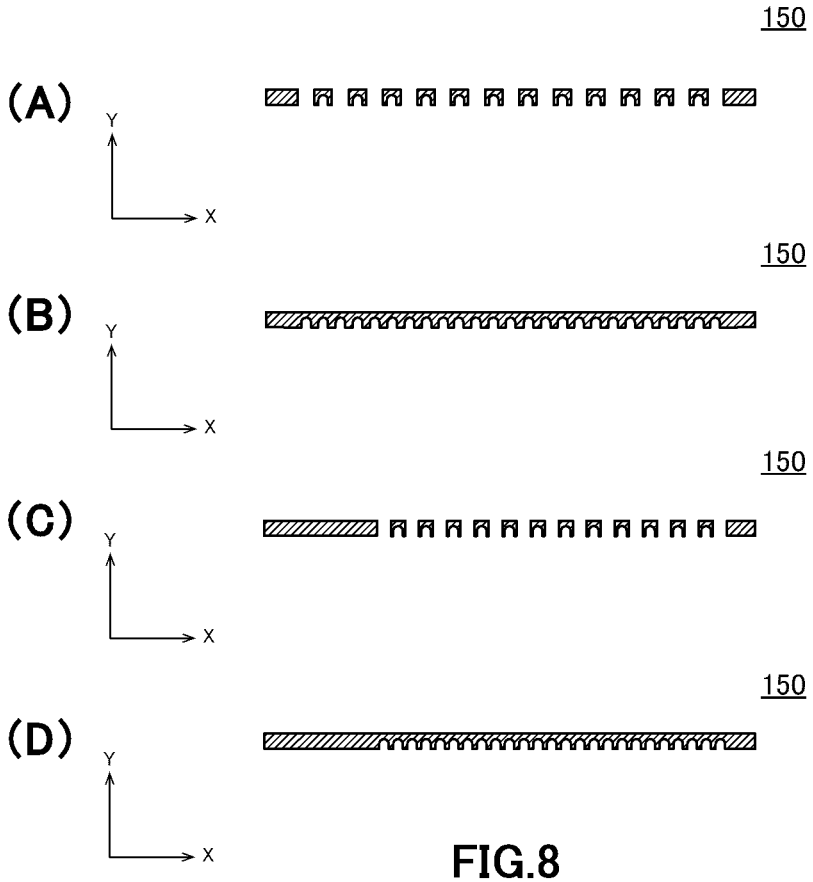
FIG. 8 is a sectional view of FIG. 7.

Sectional view along line a-a' of FIG. 7 is illustrated in FIG. 8(A), sectional view along line b-b' of FIG. 7 is illustrated in FIG. 8(B), sectional view along line c-c' of FIG. 7 is illustrated in FIG. 8(C), and sectional view along line d-d' of FIG. 7 is illustrated in FIG. 8(D). As illustrated in FIG. 8(A) and FIG. 8(C), a plurality of counterbores may be arranged at rows in which through holes are arranged in left right and up down directions. As illustrated in FIG. 8(B) and FIG. 8(D), a plurality of counterbores may be arranged additionally at rows in which through holes are not arranged in left right and up down directions. It is possible to stir more uniformly, and also, processing of counterbore is easier, when counterbores are arranged in straight lines in left right and up down directions as the above. In addition, the counterbore may not be true circle, and it may be oval or other appropriately desired shape in cross section, and it is fine as long as it is having a curved surface.

The through hole may be in quadrangle or circular shape. It is preferable that size of the through hole is 10 to 30 mm. Depth of the counterbore may be 3 to 8 mm, and radius of the counterbore may be R=3 to 8 mm. It is preferable that thickness of a plate of the paddle is 5 to 10 mm.

In this way, it is also possible to perform stirring in Z direction in FIG. 7 efficiently. In this case, it is especially effective when reciprocal movement in longitudinal or lateral direction with respect to the surface treatment tank is impossible due to small space.

Figure 9:
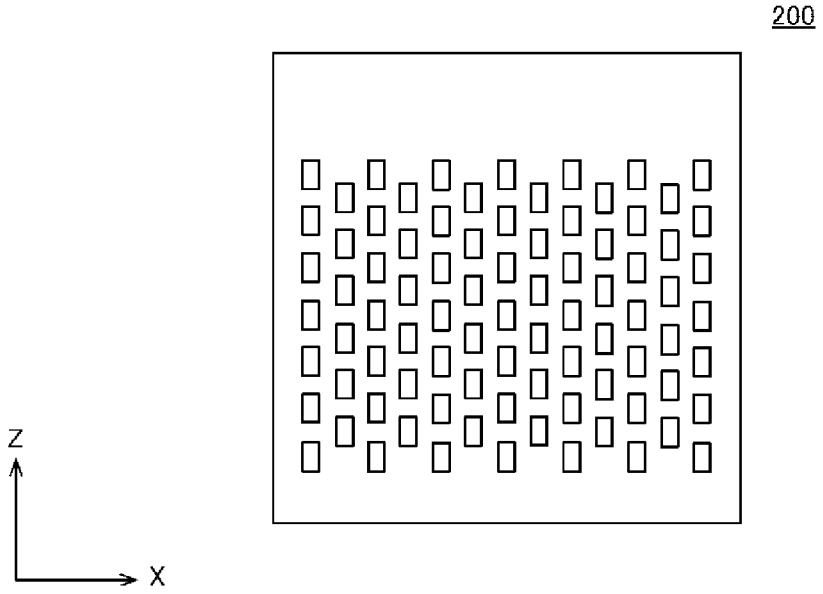
FIG. 9 is a schematic view of a paddle provided with through holes arranged in zigzag viewed from a side.

In addition, as illustrated in FIG. 9, in the paddle 200, through holes may be arranged in zigzag. In this way, it is possible to perform stirring in Z direction effectively, and also, it is possible to uniformize plating thickness more, as cross rail part always tends not to be a shield with respect to anode, when through holes are arranged in zigzag, than when through holes are not arranged as such. In addition, preferable size and shape of through hole, and preferable depth of counterbore are as the above.

[3. Surface Treatment Method]

Next, explaining about a surface treatment method relating to one embodiment of the present invention. A surface treatment method relating to one embodiment of the present invention is a method for using at least one plate-shaped paddle for stirring surface treatment solution near an object to be plated, by reciprocally moving the paddle with respect to the object to be plated.

And, the paddle is configured by integrally forming a plurality of square bars provided in depth direction of the surface treatment solution in the surface treatment tank along the object to be plated at regular intervals, and the square bar is provided with a curved surface with respect to the object to be plated in a cross section in thickness direction of the square bar.

The feature of the paddle 50 used in the surface treatment method relating to one embodiment of the present invention is as mentioned above. In addition, the paddle 150, 200 illustrated in FIG. 7 or FIG. 9 may be used. The surface treatment method relating to one embodiment of the present invention is applicable to a case when stirring in plating (electrolyte plating, nonelectrolyte plating), or pre-treatment and post-treatment of plating is necessary. In addition, applicable or preferable object to be plated is as mentioned above.

In the surface treatment method relating to one embodiment of the present invention, other than stirring by the paddle, it may be combined with stirring by bubbling. In this way, it is preferable for a case when oxygen is necessary in surface treatment solution and when dissolved oxygen should be increased.

According to the surface treatment method relating to one embodiment of the present invention, it is possible to provide the surface treatment method capable of stirring for a long period of time, by uniformizing plating thickness by uniformly stirring surface treatment solution near the object to be plated, and by improving a strength of the paddle.

In addition, it is explained in detail about each embodiment of the present invention as the above, but it can be understood easily for those who skilled in the art that various modifications are possible without practically departing from new matters and effect of the present invention. Therefore, all of such variants should be included in the scope of the present invention.

For example, terms described with different terms having broader or equivalent meaning at least once in description and drawings can be replaced with these different terms in any part of description and drawings. In addition, operation and configuration of the surface treatment device, the surface treatment method, and the paddle are not limited to those explained in each embodiment of the present invention, and various modifications can be made.

Glossary of Drawing References

10 Object to be plated
20 Surface treatment solution near an object to be plated
30 Surface treatment tank
40 Fixing member
41 Pole brace
50, 150, 200 Paddle
50R, 50B, 50L, 50U Ends of paddle
51, 52, 53, 54, 55, 56, 57, 57' Square bar
60 Power means
70 Bearing
80 Anode
90 Frame
100 Surface treatment device

The invention claimed is:

1. A surface treatment device comprising at least one paddle for stirring a surface treatment solution near an object to be plated by reciprocally moving the paddle with respect to the object to be plated the paddle located in a surface treatment tank, wherein the paddle is configured by integrally forming a plurality of square bars provided in a depth direction of the surface treatment solution in the surface treatment tank, the plurality of square bars provided at regular intervals along the object to be plated, a first square bar of the plurality of square bars is provided with a curved surface in a thickness direction of a cross-section of the first square bar, wherein the object to be plated has a surface which extends in a longitudinal direction, and the surface facing a first surface of the first square bar, and the first square bar comprising:

the first surface facing and parallel to the surface of the object, which extends in the longitudinal direction, said first surface is formed with the curved surface, a second surface of the first square bar facing in a direction orthogonal to the surface of the object, said second surface is formed with the curved surface, and wherein the curved surface extends in the longitudinal direction over the first surface and the second surface, the curved surface is in a concave shape in a cross section orthogonal to the longitudinal direction; and a second square bar of the plurality of square bars is provided with a curved surface in a thickness direction of a cross-section of the second square bar, the surface of the object to be plated facing a first surface of the second square bar, the first surface of the second square bar facing and parallel to the surface of the object to be plated, which extends in the longitudinal direction, said first surface of the second square bar is formed with a curved surface, a third surface of the second square bar facing in a direction orthogonal to the surface of the object and facing a second surface of the first square bar, said third surface of the second square bar is formed with the curved surface of the second square bar, and wherein the curved surface of the second square bar extends in the longitudinal direction over the first surface of the second square bar and the third surface of the second square bar, the curved surface of the second square bar is in a concave shape in a cross section orthogonal to the longitudinal direction.

2. The surface treatment device according to claim 1, wherein the curved surface of the first square bar is provided facing left and the curved surface of the second square bar is provided facing right with respect to the object to be plated.

3. The surface treatment device according to claim 1, wherein the regular intervals are formed such that each space between immediately adjacent square bars is 10 to 30 mm in distance along a x-direction.

4. The surface treatment device according to claim 1, wherein the first square bar or the second square bar comprises a side of 5 to 10 mm in length.

5. The surface treatment device according to claim 4, wherein the curved surface of the first square bar or the second square bar comprises a radius of 3 to 10 mm.

6. The surface treatment device according to claim 1, wherein a distance between the paddle and the object to be plated is 10 to 30 mm.

7. The surface treatment device according to claim 1, further comprising a powering means for reciprocally moving the paddle with a stroke of 50 to 200 mm, and with a moving speed of 35 to 600 mm/s.

8. The surface treatment device according to claim 1, wherein the paddle is arranged at both sides of the object to be plated.

9. A paddle for stirring a surface treatment solution near an object to be plated by reciprocally moving the paddle with respect to the object to be plated, wherein the paddle is configured by integrally forming a plurality of square bars provided in one direction at regular intervals along the object to be plated, a first square bar of the plurality of square bars is provided with a curved surface in a cross section in a thickness direction of the first square bar, wherein the object to be plated has a surface which extends in a longitudinal direction, and the surface facing a first surface of the first square bar, and the first square bar comprising: the first surface facing and parallel to the surface of the object, which extends in the longitudinal direction, said first surface is formed with the curved surface of the first square bar, a second surface facing in a direction orthogonal to the surface of the object, said second surface is formed with the curved surface, and wherein the curved surface extends in the longitudinal direction over the first surface and the second surface of the first square bar, the curved surface is in a concave shape in a cross section orthogonal to the longitudinal direction;

a second square bar of the plurality of square bars is provided with a curved surface in a thickness direction of a cross-section of the second square bar, the surface of the object to be plated facing a first surface of the second square bar, the first surface of the second square bar facing and parallel to the surface of the object to be plated, which extends in the longitudinal direction, said first surface of the second square bar is formed with a curved surface, a third surface of the second square bar facing in a direction orthogonal to the surface of the object and facing a second surface of the first square bar, said third surface of the second square bar is formed with the curved surface of the second square bar, and wherein the curved surface of the second square bar extends in the longitudinal direction over the first surface of the second square bar and the third surface of the second square bar, the curved surface of the second square bar is in a concave shape in a cross section orthogonal to the longitudinal direction.

* * * * *